US008327863B1

(12) United States Patent
Dupree

(10) Patent No.: US 8,327,863 B1
(45) Date of Patent: Dec. 11, 2012

(54) WEIGHTED CHARM DEVICE FOR UMBRELLAS

(76) Inventor: Druscilla Dupree, Mission Viejo, CA (US)

( * ) Notice: Subject to any disclaimer, the term of this patent is extended or adjusted under 35 U.S.C. 154(b) by 436 days.

(21) Appl. No.: 12/622,224

(22) Filed: Nov. 19, 2009

(51) Int. Cl.
*A45B 3/00* (2006.01)

(52) U.S. Cl. ..... 135/16; 220/603; 248/500; 248/910

(58) Field of Classification Search ..... 248/500, 248/910; 135/16, 33.41; 150/112; 224/915; 220/603
See application file for complete search history.

(56) References Cited

U.S. PATENT DOCUMENTS

| | | | | |
|---|---|---|---|---|
| 2,923,449 | A | 2/1960 | Sund | |
| 4,296,693 | A * | 10/1981 | Archer | 108/28 |
| D284,618 | S | 7/1986 | St. John | |
| 4,832,163 | A * | 5/1989 | Levesque | 190/11 |
| 4,924,893 | A * | 5/1990 | Furey | 135/16 |
| 5,339,770 | A | 8/1994 | Haffner | |
| 5,370,570 | A | 12/1994 | Harris | |
| 5,452,877 | A * | 9/1995 | Riffle et al. | 248/511 |
| 5,520,364 | A * | 5/1996 | Bloxson et al. | 248/500 |
| D373,468 | S | 9/1996 | Dubinsky | |
| 5,843,556 | A * | 12/1998 | Levas | 428/99 |
| 5,909,811 | A * | 6/1999 | Harris | 206/581 |
| 6,290,197 | B1 * | 9/2001 | Newton | 248/346.2 |
| 6,446,930 | B1 | 9/2002 | Li | |
| D486,302 | S | 2/2004 | Van Dam | |
| 7,168,437 | B2 * | 1/2007 | Bigford | 135/16 |
| 7,347,428 | B2 | 3/2008 | Edenso | |
| 7,581,555 | B2 * | 9/2009 | McCullough | 135/33.2 |
| 7,946,305 | B1 * | 5/2011 | Mailman | 135/16 |
| 8,042,561 | B2 * | 10/2011 | Moravec Varga et al. | 135/16 |
| 2008/0023617 | A1 * | 1/2008 | Ho | 248/500 |

FOREIGN PATENT DOCUMENTS

JP 2003278162 A * 10/2003

* cited by examiner

*Primary Examiner* — Sue Weaver

(57) ABSTRACT

A weighted charm device for attaching to an umbrella, said weighted charm device comprising a housing, the housing being constructed in various shapes such as a pouch, a star, a moon, a sun, a bottle of beer, a piece of sporting equipment, or a holiday shape; a first pocket disposed in the housing, the first pocket being for holding a weight component; a second pocket disposed in the housing, the second pocket being for storing an item, wherein the second pocket comprises a lining; and an attachment means disposed on an edge of the housing for attaching the housing to an inside bracket of the umbrella.

5 Claims, 3 Drawing Sheets

WEIGHTED CHARM DEVICE FOR UMBRELLAS

FIELD OF THE INVENTION

The present invention is directed to an umbrella accessory, more particularly to weighted devices for attaching to the inside brackets of an umbrella to help prevent the umbrella from turning inside out or from blowing away.

BACKGROUND OF THE INVENTION

In many situations that an umbrella is used the umbrella is at risk of being blown away or turned inside out. For example, coastal breezes can easily blow down a beach umbrella. The present invention features a weighted charm device for helping prevent an umbrella from being blown inside out or blown away.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Figure 1:
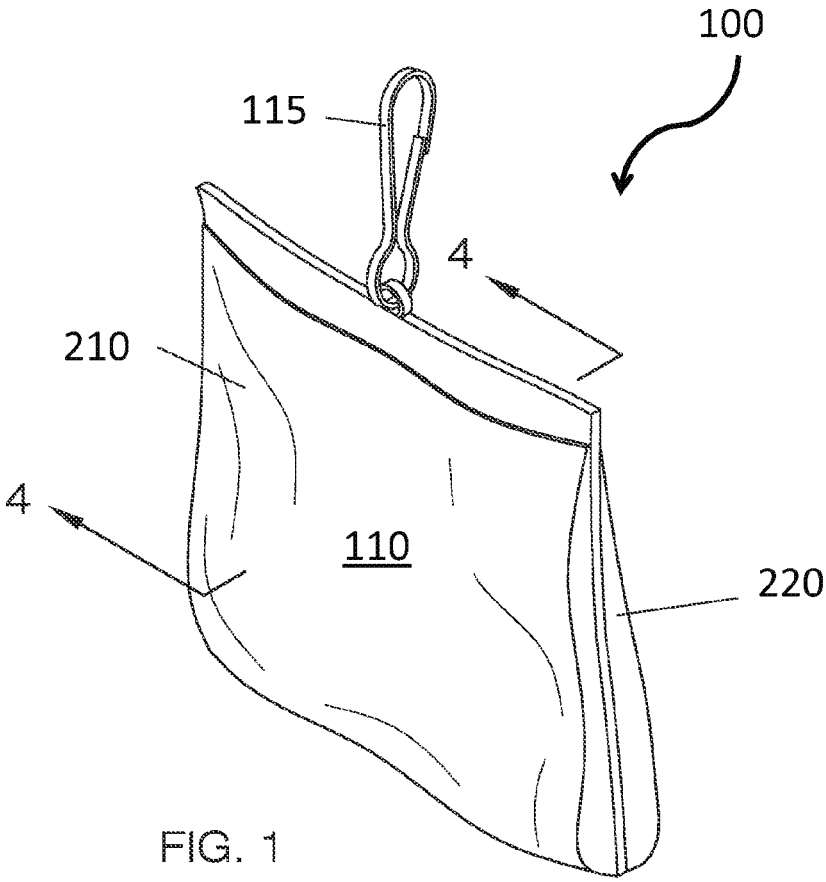
FIG. 1 is a first perspective view of the weighted charm device of the present invention.
Figure 2:
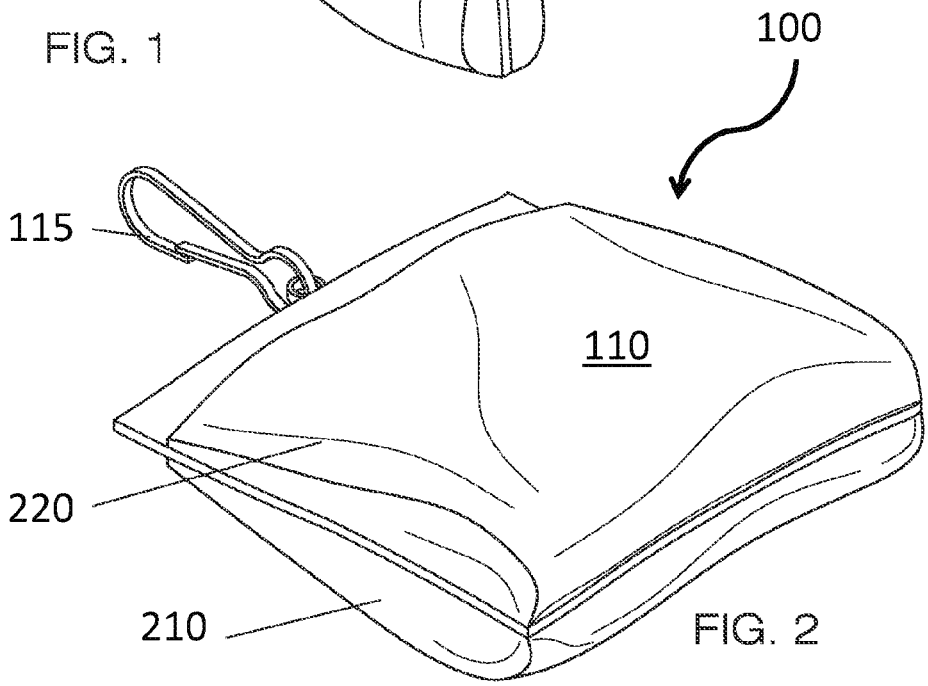
FIG. 2 is a second perspective view of the weighted charm device of the present invention.
Figure 3:
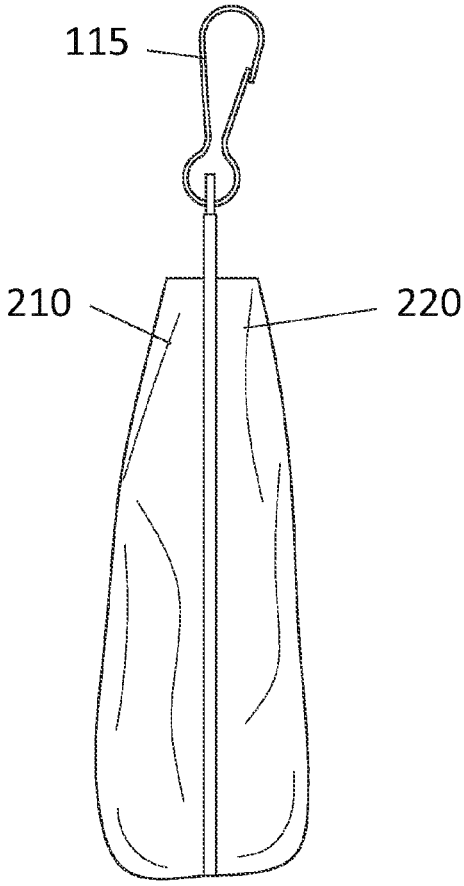
FIG. 3 is a side view of the weighted charm device of the present invention.
Figure 4:
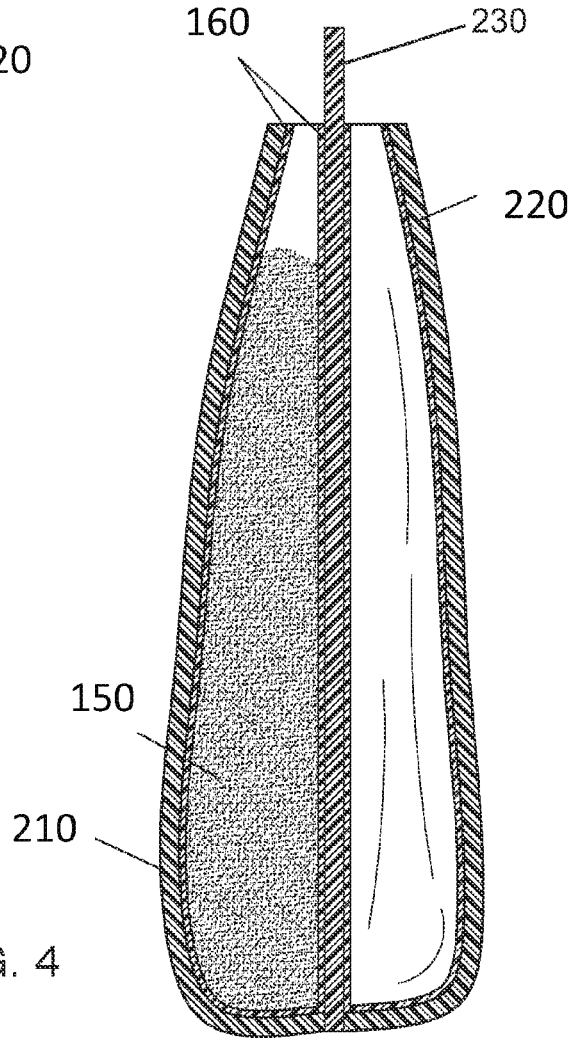
FIG. 4 is a side cross sectional view of the weighted charm device of the present invention.

Referring now to FIGS. 1-5, the present invention features a weighted charm device 100 for attaching to inside brackets 104 of an umbrella 102. Without wishing to limit the present invention to any theory or mechanism, it is believed that the charm device 100 of the present invention is advantageous because it can help prevent the umbrella 102 from turning inside out or from blowing away. The charm device 100 may be used for any type of umbrella, for example a beach umbrella, a patio umbrella, and the like.

The weighted charm device 100 of the present invention comprises a housing 110. The housing 110 may be constructed in a variety of shapes. For example, the housing 110 may be constructed in the shape of a pouch, a star 201, a moon 203, a sun, a bottle of beer 202, a piece of sporting equipment (e.g., football 204, soccer ball, tennis ball, basketball, etc.), a holiday shape (e.g., a Christmas ornament, a pumpkin, a turkey, a heart, a four-leaf clover, etc.). Examples of the housing 110 may be seen in FIG. 5. The housing 110 is not limited to the aforementioned examples.

A first pocket 210 is disposed in the housing 110. The first pocket is for holding a weight component 150. In some embodiments, the weight component 150 is sand (e.g., sandbag) or one or more metal weights. The weight component 150 is not limited to the aforementioned examples.

In some embodiments, a second pocket 220 is disposed in the housing 110. The second pocket 220 may be for storing a plurality of items such as sunscreen 320, sunglasses 330, keys, money, portable electronics, the like, or a combination thereof. A divider 230 is attached to the bottom inside of the housing 110 and extends towards the opposing top edge. The divider 230 separates the first pocket 210 from the second pocket 220. In some embodiments, the first pocket 210 and/or second pocket 220 comprise a lining 160 (e.g., plastic lining) for providing a mess-free means of storing food products.

Figure 5:
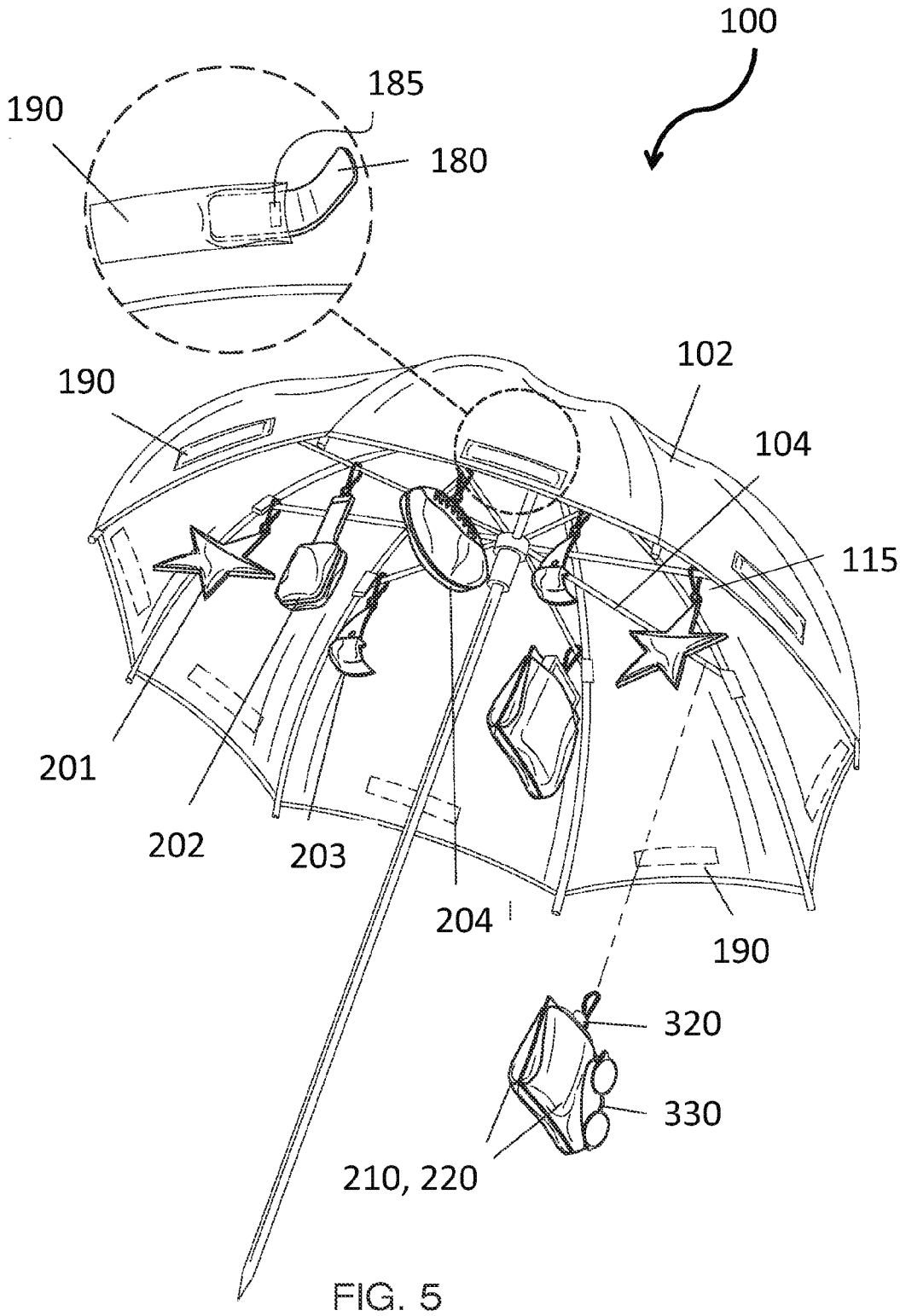
FIG. 5 is a perspective view of a plurality of charm devices at attached to an umbrella.

Disposed on an edge of the housing 110 is an attachment means for attaching (e.g., temporarily attaching) the housing 110 to an umbrella 102. Generally, the housing 110 is attached to the inside brackets 104 of the umbrella 102. In some embodiments, the attachment means includes a clip mechanism 115. In some embodiments, the attachment means includes a hook-and-loop fastener mechanism, an adhesive mechanism, a tie mechanism, the like, or a combination thereof. As shown in FIG. 5, a plurality of charm devices 100 can be attached to an umbrella 102.

The present invention also features weighted bars 180 for attaching to an umbrella 102. As shown in FIG. 5, the weighted bars 180 are positioned near the bottom edges of the umbrella. In some embodiments, the weighted bars 180 are sewn to the umbrella 102. In some embodiments, pockets 190 are disposed (e.g., fixedly attached, removably attached) on the umbrella 102 (e.g., near the bottom edges), the pockets 190 are adapted to hold the weighted bar 180. As shown in FIG. 5, the weighted bars 180 can slide in and out of the pockets 190, and the pockets 190 can be closed via securing means 185. In some embodiments, the securing means 185 includes a hook-and-loop fastener, a clip, a hook, a snap, the like, or a combination thereof.

The following the disclosures of the following U.S. Patents are incorporated in their entirety by reference herein: U.S. Pat. No. 5,339,770; U.S. Pat. No. 7,347,428; U.S. Pat. No. 5,370,570; U.S. Pat. No. 6,446,930.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

What is claimed is:

1. A weighted charm system for attaching to an inside bracket of an umbrella, said weighted charm system comprising:

(a) a housing, having a top edge and a bottom edge:

(b) a first pocket disposed in the housing, the first pocket being for holding a weight component;

(c) a second pocket disposed in the housing, the second pocket being for storing an item, wherein the second pocket comprises a lining;

(d) a divider attaching to a bottom inside of the housing and extending towards the opposing top edge, the divider separating the first pocket from the second pocket; and (e) inside bracket of the umbrella (f) an attachment means disposed on an edge of the housing for attaching the housing to the inside bracket of the umbrella;

wherein the first pocket of the housing is filled with the weight component, the second pocket of the housing is optionally used to store an item, and the housing is attached to the inside bracket of the umbrella to help prevent the umbrella from turning inside out in turbulent wind conditions.

2. The weighted charm system of claim 1, wherein the housing is constructed in a shape of a pouch, a star, a moon, a sun, a bottle of beer, a piece of sporting equipment, a football, a soccer ball, a tennis ball, a basketball, a holiday shape, a Christmas ornament, a pumpkin, a turkey, a heart, or a four-leaf clover.

3. The weighted charm system of claim 1, wherein the weight component is sand, a metal weight, or a combination thereof.

4. The weighted charm system of claim 1, wherein the item includes food, sunscreen, sunglasses, keys, money, a portable electronic device, or a combination thereof.

5. The weighted charm system of claim 1, wherein the lining is plastic.

* * * * *